United States Patent [19]

Su

[11] Patent Number: 5,012,709

[45] Date of Patent: May 7, 1991

[54] IMPACT SCREW DRIVER

[76] Inventor: Jen-Sung Su, No. 1, Lane 155, Sec. 1, Chang-Ping Rd., Taichung City, Taiwan

[21] Appl. No.: 566,509

[22] Filed: Aug. 13, 1990

[51] Int. Cl.[5] ..... B25B 19/00

[52] U.S. Cl. ..... 81/466; 173/93; 81/463

[58] Field of Search ..... 81/463, 465, 466; 173/93, 93.7, 119

[56] References Cited

U.S. PATENT DOCUMENTS

| | | | |
|---|---|---|---|
| 2,914,978 | 12/1959 | Crick | 173/93.7 |
| 4,745,980 | 5/1988 | Chung | 173/93.7 |
| 4,919,216 | 4/1990 | Ikegami | 173/119 X |

*Primary Examiner*—D. S. Meislin
*Attorney, Agent, or Firm*—Pasquale A. Razzano

[57] ABSTRACT

An impact screw driver includes a tubular handle, an impact rod slidable axially within the handle, and a handle cap mounted detachably on the top end of the handle. A driving rod rests on the top end of the impact rod and has an open top end and a lower end spring seat, on which a torsion spring is provided to bias a driving head to move upward. The impact rod and the driving rod are both guided to move axially in the handle. A sleeve head connects a tool bit to the driving head. A compression spring is sleeved on the driving head and placed over the driving rod so as to bias the driving rod and the impact rod to move downward. A ball is retained on the wall of the driving rod. A cam slot is formed in the driving head so as to receive the ball slidably in the cam slot. The cam slot is shaped so as to convert axial movement of the driving rod into rotational movement of the driving head.

3 Claims, 8 Drawing Sheets

IMPACT SCREW DRIVER

BACKGROUND OF THE INVENTION

This invention relates to a screw driver, more particularly to a highly efficient impact screw driver which is easily manufactured and assembled.

Referring to FIG. 1, when using an earlier conventional impact screw driver 1 made of metal, the operator grips the screw driver 1 with one hand, and holds a hammer 2 with another hand, so as to strike the end of the screw driver 1 with the hammer 2. It is difficult to simultaneously carry the heavy screw driver 1 and the hammer 2. To overcome this drawback, as shown FIG. 2, an improved impact screw driver has been developed which includes an impact hammer 1 which can move downward to compress a coiled spring 2. Then, the compressed spring 2 pushes the tool bit downward. Because the push of the spring 2 is not a direct force, the efficiency of the screw driver suffers.

SUMMARY OF THE INVENTION

It is therefore the main object of this invention to provide a highly efficient impact screw driver.

According to this invention, an impact screw driver includes a tubular handle, an impact rod slidable axially within the handle, and a handle cap mounted detachably on the top end of the handle. A driving rod rests on the top end of the impact rod and has an open top end and a lower end spring seat, on which a torsion spring is provided to bias a driving head to move upward. The impact rod and the driving rod are both guided to move axially in the handle. A sleeve head connects a tool bit to the driving head. A compression spring is sleeved on the driving head and placed over the driving rod so as to bias the driving rod and the impact rod to move downward. A ball is retained on the wall of the driving rod. A cam slot is formed in the driving head so as to receive the ball slidably in the cam slot. The cam slot is shaped to convert the axial movement of the driving rod into rotational movement of the driving head. Therefore, a direct impact is transferred from the impact rod to the tool bit through the driving rod and the driving head. Furthermore, the compression of the torsion spring facilitates the rotation of the driving head relative to the driving rod, thereby enhancing the impact effect of the screw driver.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
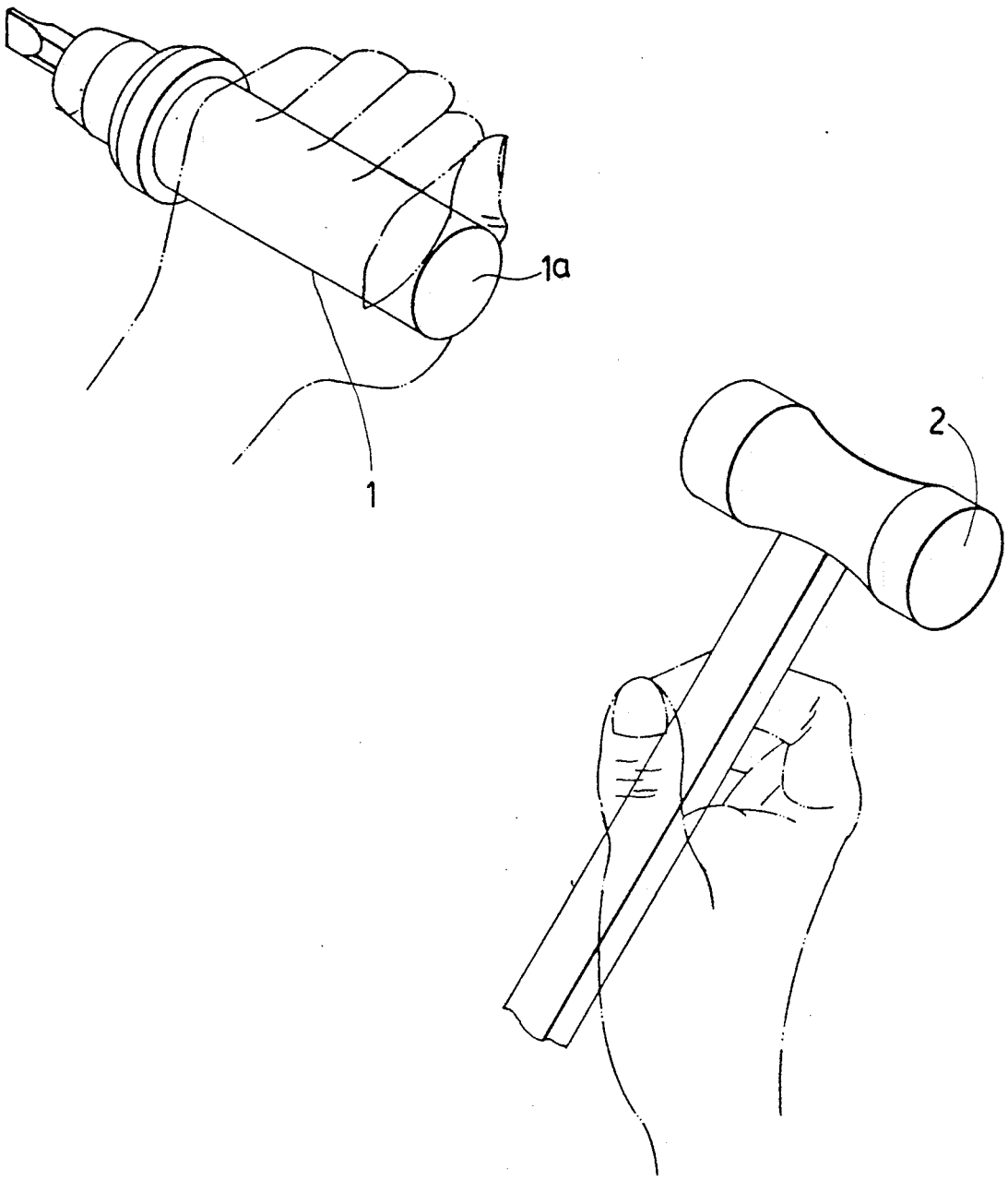
FIG. 1 PRIOR ART
FIG. 1 is a schematic view illustrating the use of an earlier conventional impact screw driver.
Figure 2:
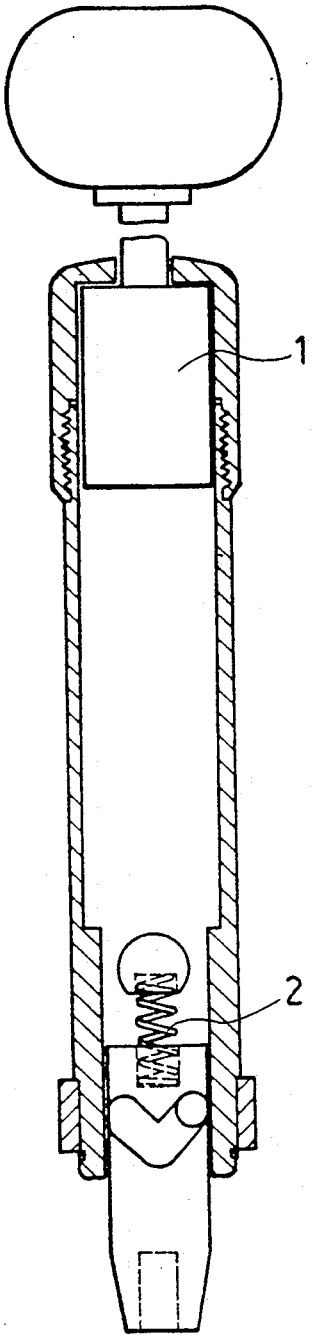
FIG. 2 PRIOR ART
FIG. 2 is a sectional view showing another conventional impact screw driver.
Figure 3:
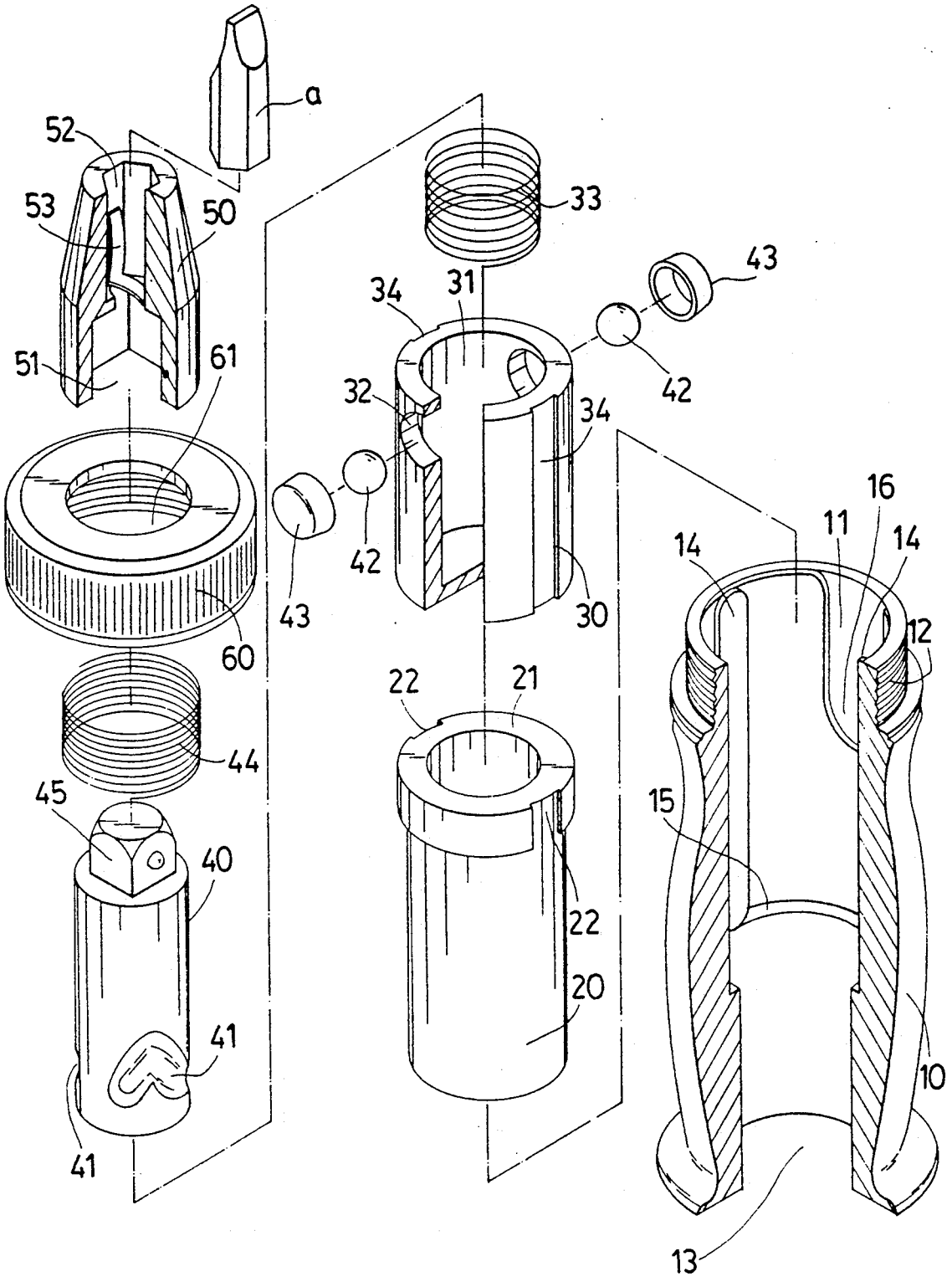
FIG. 3 is an exploded view of an impact screw driver according to this invention.
Figure 4:
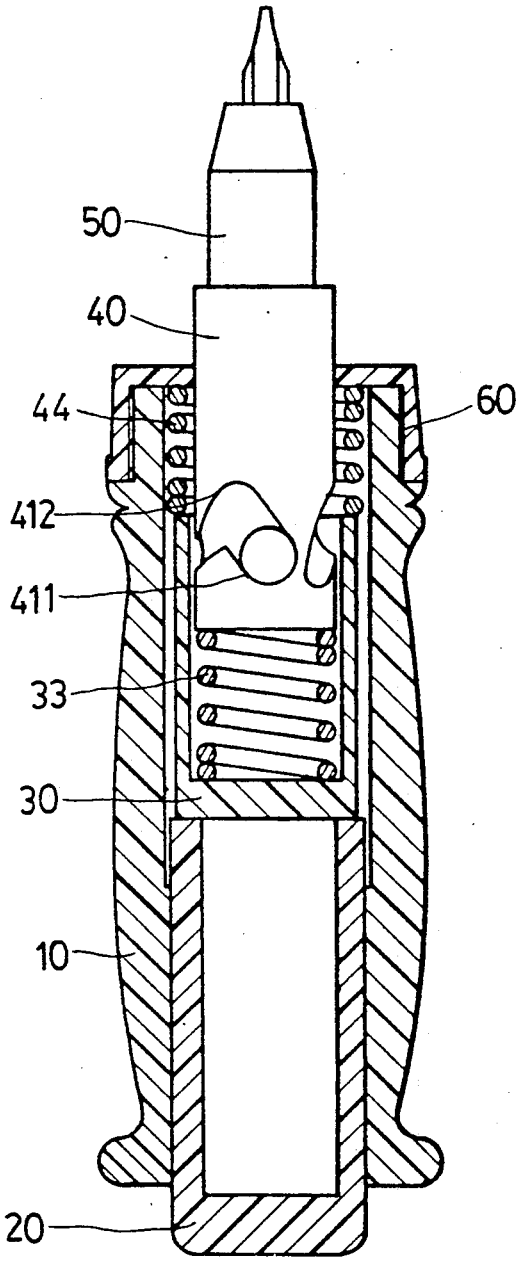
FIG. 4 is an assembled sectional view showing the impact screw driver of this invention in which the impact rod is at the normal position.

Referring to FIGS. 3 and 4, an impact screw driver of this invention includes a tubular handle 10, an impact rod 20, a driving rod 30, a driving head 40, a sleeve head 50 and a handle cap 60.

The handle 10 includes an open top end 11, an externally threaded top end portion 12, an open bottom end 13 two opposed axial guide ribs 14 projecting from the inner surface of the handle 10, a shoulder 15 provided on the inner surface of the handle 10, and two opposed recesses 16 formed in the top end portion of the inner surface of the handle 10.

The impact rod 20 is mounted slidably in the handle 10 and includes an increased-diameter top end portion 21, and two opposed first guide slots 22 formed along the entire length of the outer surface of the top end portion 21 of the rod 20 and engaged with the respective guide ribs 14 of the handle 10.

The driving rod 30 has an open top end 31, a closed bottom end, two opposed ball holes 32 formed through the wall of driving rod 30, a coiled torsion spring 33 placed on the bottom wall or spring seat of the driving rod 30, and two opposed second guide slots 34 formed along the entire length of the outer surface of the driving rod 30 in alignment with the first guide slots 22 and engaged with the respective guide ribs 14 of the handle 10. Because the guide ribs 14 are each engaged in one of the first guide slots 22 of the impact rod 20, and in one of the second guide slots 34 of the driving rod 30, the impact rod 20 and the driving rod 30 can move axially in the handle 10.

The driving head 40 includes two inverted V-shaped cam slots 41 formed through the wall thereof, two guide means or balls 42 each retained in one of the cam slots 41 and one of the ball holes 32 by a cup-like retainer 43, a coiled compression spring 44 sleeved on the driving head 40 and placed over the driving rod 30, and a generally square coupling end 45. The retainers 43 are truncately conic and are inserted through the respective ball holes 32 from the interior of the driving rod 30, extending into the respective recesses 16 of the handle 10. The balls 42 are placed in their respective retainers 43.

The sleeve head 50 extends through the central bore 61 of the handle cap 60 and includes a bottom end coupling hole 51 shaped to conform to the coupling end 45 of the driving head 40; a hexagonal top end coupling hole 52; and a spring reed 53 secured in the hexagonal hole 52. When a tool bit (a), which has a hexagonal bottom end portion, is inserted into the hexagonal hole 52, the spring reed 53 retains the bit (a) within the hexagonal hole 52.

The handle cap 60 has an internally threaded portion to cooperate with the externally threaded top end portion 12 of the handle 10, so as to secure the cap 60 there.

The handle 10, the impact rod 20, the driving rod 30 and the handle cap 60 are made of plastic, for convenience's sake. It is understood that the impact screw driver of this invention is easily manufactured and assembled.

Figure 5:
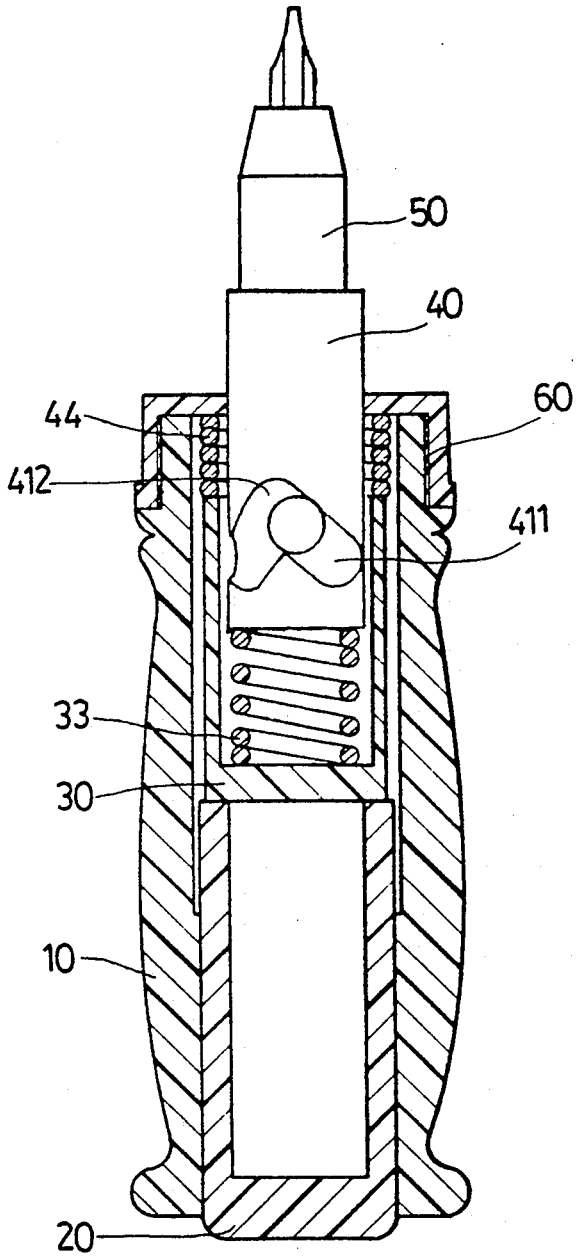
FIG. 5 is a sectional view showing the impact screw driver of this invention in which the impact rod is pressed.
Figure 6:
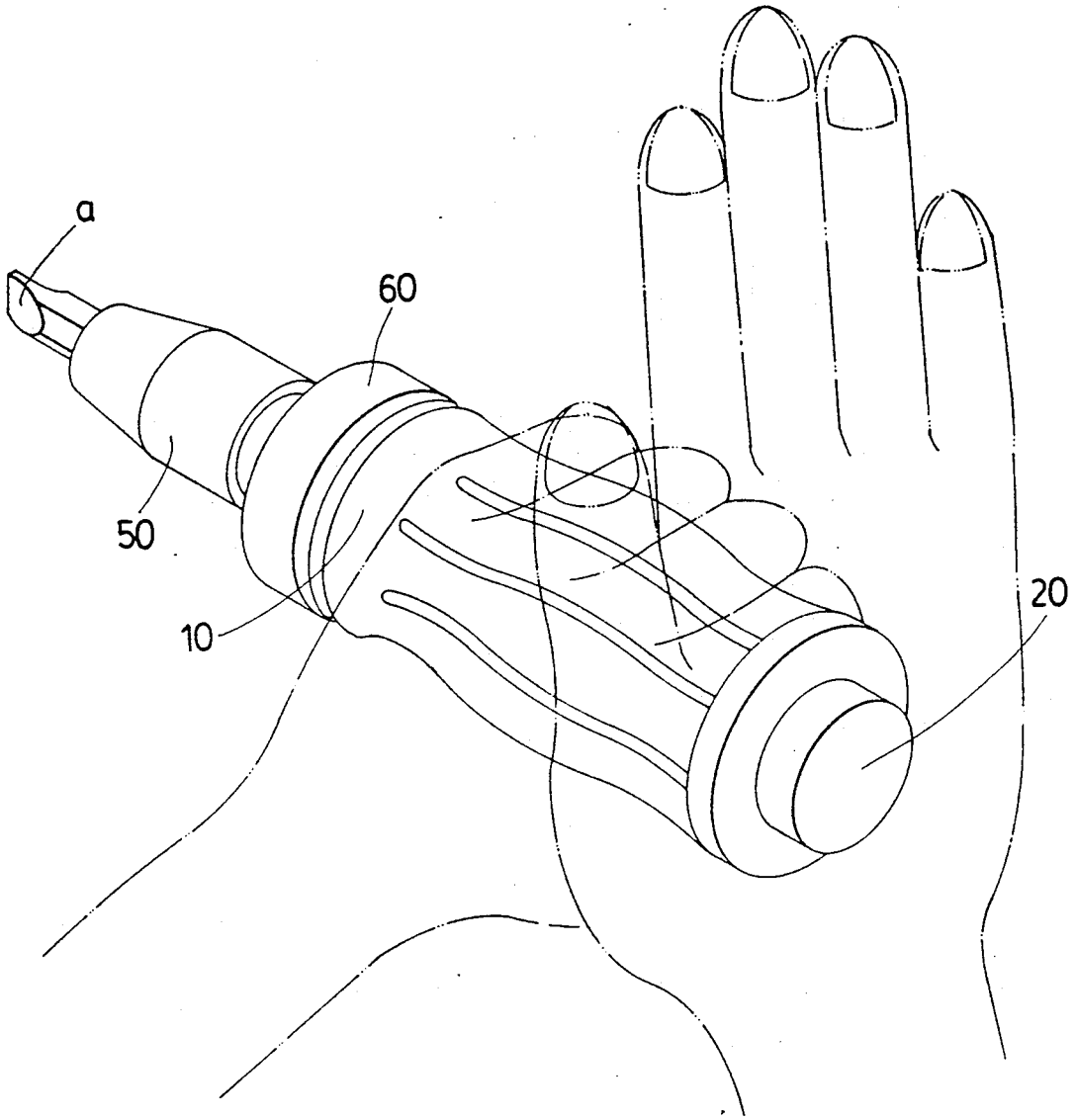
FIG. 6 is a schematic view illustrating how to operate the impact screw driver in accordance with this invention.

Referring to FIGS. 5 and 6, when the impact rod 20 is entirely pressed into the handle 10 by one hand, impelling the driving rod 30, the balls 42 push the driving head 40 upward and slide from the lower dead points 411 to the upper dead points 412 in the cam slots 41 of the driving head 40, so as to rotate the driving head 40 relative to the driving rod 30. At the same time, the torsion spring 33 is compressed between the driving rod 30 and the driving head 40, facilitating the rotation of the driving head 40 relative to the driving rod 30. When the user lets go of the impact rod 20, the torsion spring 33 and the compression spring 44 cooperate to return the impact screw driver to the extended position.

It can be appreciated that a direct impact is transferred from the impact rod 20 to the tool bit (a) through the driving rod 30 and the driving head 40.

Figure 7:
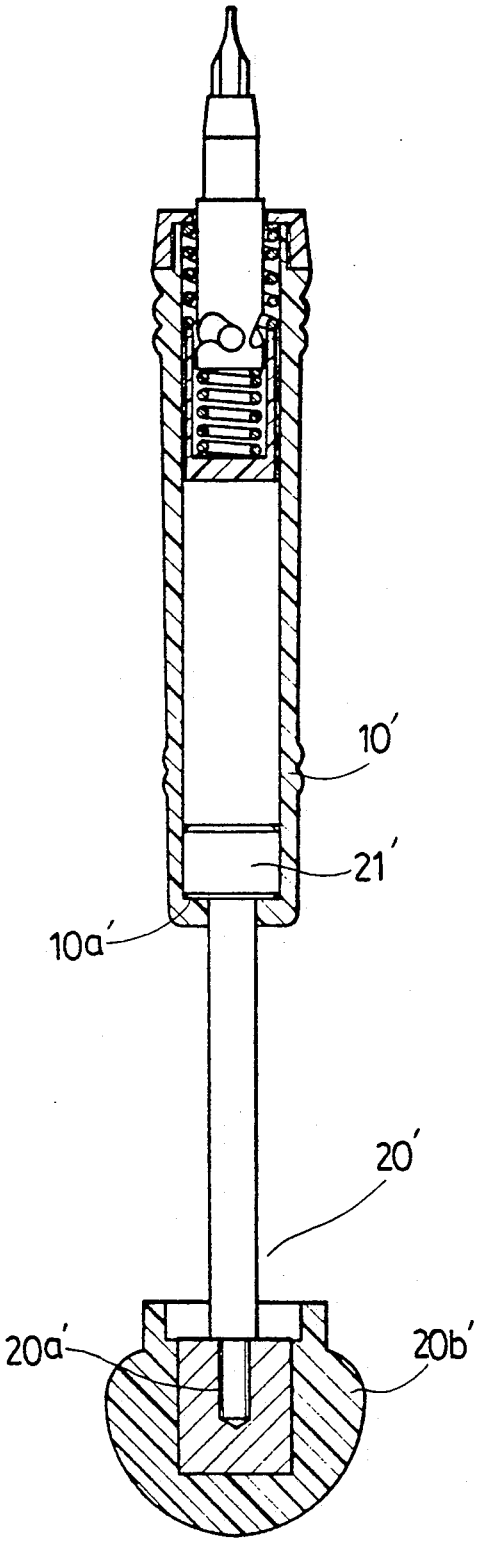
FIG. 7 is a sectional view of another impact screw driver according to this invention in which the impact rod is at the normal position.
Figure 8:
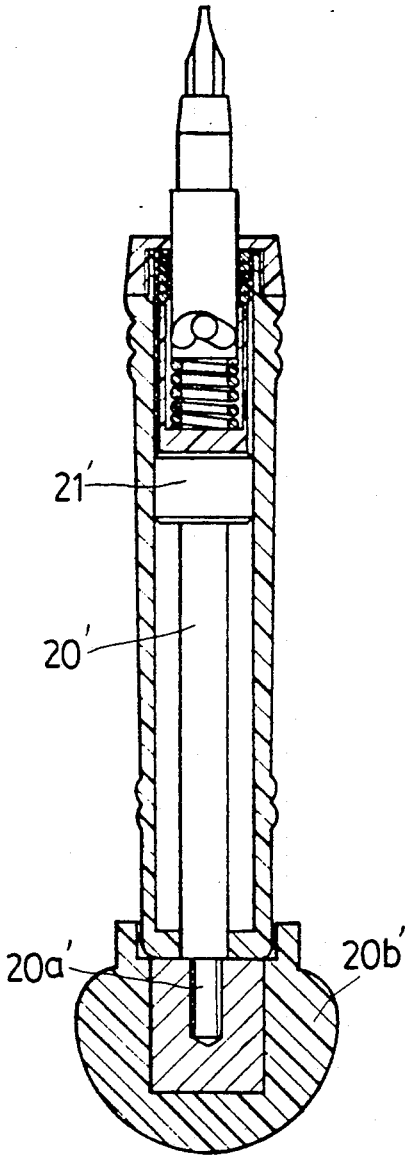
FIG. 8 is a sectional view showing the impact screw driver of FIG. 7, in which the impact rod extends from the handle.

FIG. 7 shows another embodiment of the impact screw driver according to this invention. As illustrated, unlike the first embodiment, this embodiment includes a handle 10' with a bottom end inward flange **10*a'*, and an elongated impact rod 20' extending through the inward flange 10*a'*. The inward flange 10*a'* prevents the increased-diameter top end portion 21' of the impact rod 20' from escaping from the handle 10'. The impact rod 20' has an externally threaded bottom end 20*a'* with which an internally threaded knob 20*b'*** is engaged.

With this invention thus explained, it is apparent that numerous modifications and variations can be made without departing from the scope and spirit of this invention. It is therefore intended that this invention be limited only as indicated in the appended claims.

I claim:

1. An impact screw driver comprising:

a tubular handle having a top end and a bottom end;

a handle cap mounted detachably on said top end of said handle, said handle cap having a central hole formed therethrough;

an impact rod, slidable axially within said handle, having a top end and a bottom end which is biased to extend from said bottom end of said handle;

a driving rod, slidable axially within said handle, including an open top end and a bottom end which abuts said top end of said impact rod, a spring seat disposed on said bottom end of said driving rod, and a guide means retained on a wall of said driving rod;

a driving head disposed slidably within said driving rod and having a top end extending through said top end of said driving rod and said central hole in said handle cap, a bottom end positioned in said driving rod, and a cam slot means formed in said driving head receiving slidably therein said guide means of said driving rod whereby axial movement of said driving rod is converted into rotational movement of said driving head, relative to said driving rod;

a coiled torsion spring placed on said spring seat in said driving rod under said driving head so as to bias said driving head to move upward;

a coiled compression spring sleeved on said driving head and placed over said driving rod in said handle so as to bias said driving rod and said impact rod to move downward;

a tool bit; and a sleeve head connecting said tool bit to said driving head.

2. An impact screw driver as claimed in claim 1, wherein said impact rod has an enlarged top end portion in which a first guide slot is formed, said driving rod having a second guide slot formed therein in alignment with said first guide slot, said handle including an axial guide rib projecting from an inner surface thereof and received slidably within said first and second guide slots, whereby, said driving rod and said impact rod can move axially in said handle.

3. An impact screw driver as claimed in claim 1, wherein said cam slot means is an inverted V-shaped cam slot.

* * * * *